US005480068A

United States Patent [19]

Frazier et al.

[11] Patent Number: 5,480,068

[45] Date of Patent: Jan. 2, 1996

[54] SECURED DISPOSABLE LIQUID SOAP DISPENSER

[75] Inventors: Alan D. Frazier, West Chester; Richard P. Lewis, Oaks Meeting, both of Pa.

[73] Assignee: Scott Paper Company, Delaware County, Pa.

[21] Appl. No.: 265,830

[22] Filed: Jun. 27, 1994

Related U.S. Application Data

[62] Division of Ser. No. 31,116, Mar. 12, 1993, Pat. No. 5,350, 087, which is a division of Ser. No. 661,273, Feb. 26, 1991, Pat. No. 5,240,147.

[51] Int. Cl.[6] ..... B67D 5/64

[52] U.S. Cl. ..... 222/153.03; 222/184; 222/325; 222/383.1; 248/500; 248/551; 292/59

[58] Field of Search ..... 222/153.03, 173, 222/180, 184, 181, 325, 463, 321, 383.1, 384, 385; 292/164, 174, 302, 163, 4, 57, 59; 70/345, 387; 221/152, 154; 248/500, 551, 553, 506, 510

[56] References Cited

U.S. PATENT DOCUMENTS

| | | | |
|---|---|---|---|
| 923,447 | 6/1909 | Schmidt . | |
| 1,094,615 | 4/1914 | Watrous | 22/181 X |
| 1,139,316 | 5/1915 | Valkenburgh . | |
| 1,184,878 | 5/1916 | Rosenstock | 222/181 X |
| 1,229,556 | 6/1917 | Watrous . | |
| 1,290,435 | 1/1919 | Watrous | 222/180 |
| 1,647,245 | 11/1927 | Morrill | 222/153 X |
| 1,819,382 | 8/1931 | Palmer | 222/181 |
| 2,200,702 | 5/1940 | Oddie | 292/19 X |
| 2,503,315 | 4/1950 | Baker | 292/163 X |
| 2,520,003 | 8/1950 | Gilmore | 222/153 |
| 2,583,688 | 1/1952 | Dobkin | 222/180 |
| 2,605,021 | 7/1952 | Churchill et al. | 222/153 |
| 2,749,165 | 6/1956 | Coulter | 292/302 X |
| 2,837,245 | 6/1958 | Grebowiec | 222/184 |
| 3,183,030 | 5/1965 | Schlueter | 292/303 |
| 3,186,746 | 6/1965 | Attwood et al. | 292/303 |
| 3,235,299 | 2/1966 | Kobryner | 292/303 |
| 3,349,967 | 4/1966 | Schneller | 222/130 |
| 3,411,329 | 11/1968 | Goosman | 248/553 X |
| 3,908,942 | 9/1975 | Keith et al. | 248/551 X |
| 3,918,752 | 11/1975 | Leone et al. | 292/302 X |
| 4,022,504 | 5/1977 | Anderson | 292/340 |
| 4,220,363 | 9/1980 | Foster, Jr. et al. | 292/164 |
| 4,280,638 | 7/1981 | Keihm | 222/180 |
| 4,535,870 | 8/1985 | Lindsay | 292/19 X |
| 4,560,093 | 12/1985 | Cassia | 222/181 |
| 4,582,227 | 4/1986 | Kanfer | 222/180 X |
| 4,676,370 | 6/1987 | Rudick | 292/303 X |
| 4,973,023 | 11/1990 | O'Neill | 248/553 X |
| 5,062,549 | 11/1991 | Smith et al. | 222/184 X |
| 5,148,948 | 9/1992 | Granville et al. | 222/153 X |

FOREIGN PATENT DOCUMENTS

| | | |
|---|---|---|
| 701809 | 1/1954 | United Kingdom . |
| 811596 | 4/1959 | United Kingdom . |

*Primary Examiner*—Andres Kashnikow
*Assistant Examiner*—Lisa Douglas
*Attorney, Agent, or Firm*—Woodcock Washburn Kurtz Mackiewicz & Norris

[57] ABSTRACT

Disclosed is a theft deterring countertop mounted fluid dispensing system for dispensing liquid soap using a liquid soap dispenser which can be disposable. The system includes a base unit or module adapted to be permanently affixed to a countertop. The base unit includes a locking mechanism and at least one lug orifice. The base unit is used in conjunction with the fluid dispensing unit or module which includes a bottle for storing the liquid soap and a lug extending from the bottle, The lug is receivable in the lug orifice of the base unit and releasably engaged by the locking mechanism therein. A key or series of movements which are not readily obvious to a casual user of the product are required in order to remove the fluid dispensing unit from the base unit.

7 Claims, 9 Drawing Sheets

FIGURE 4
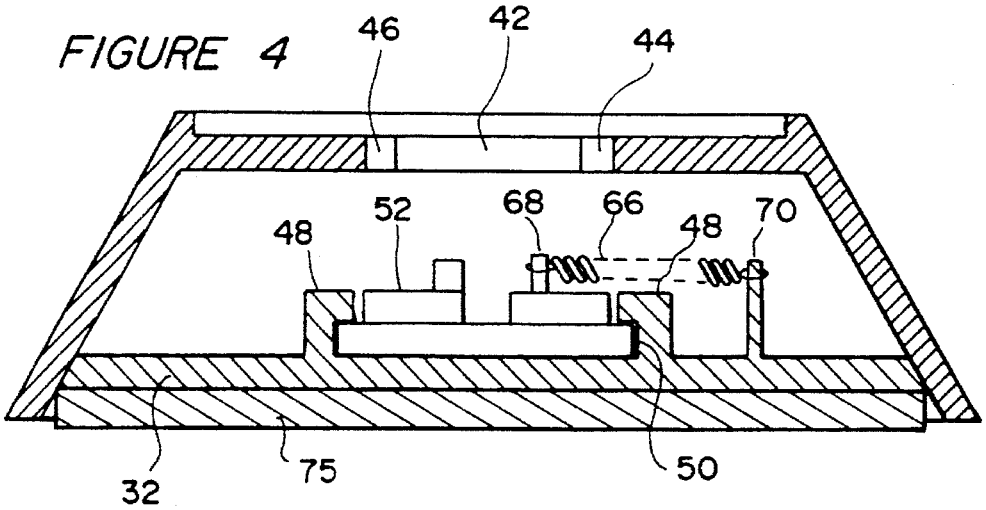
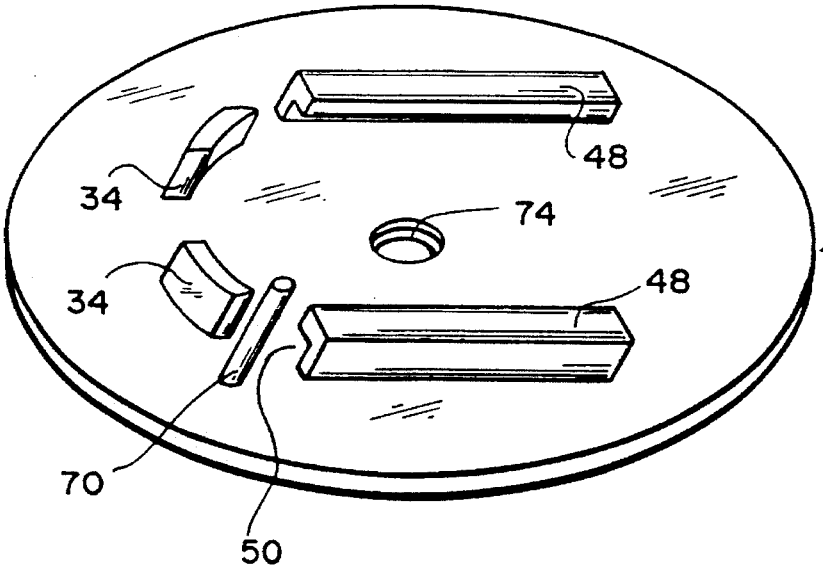
FIGURE 6

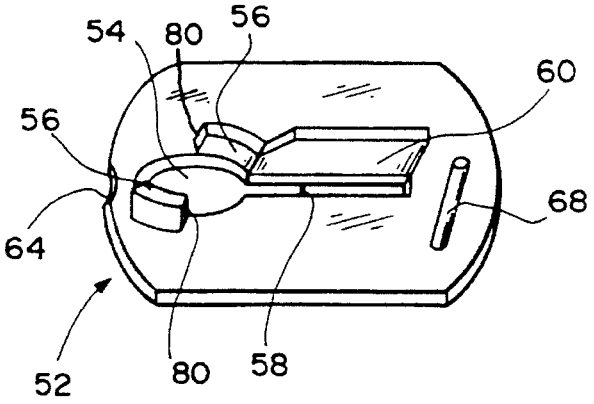
FIGURE 5
FIGURE 7
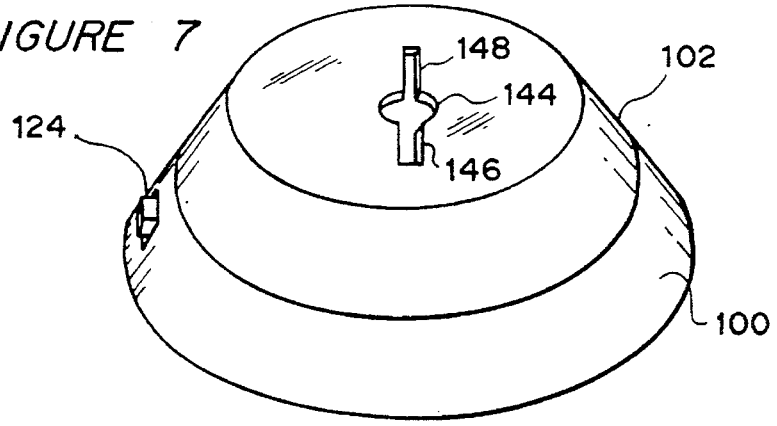
FIGURE 8
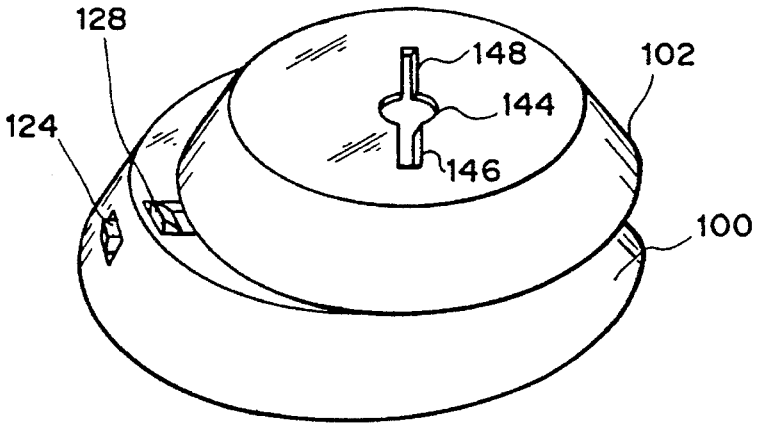

FIGURE 9
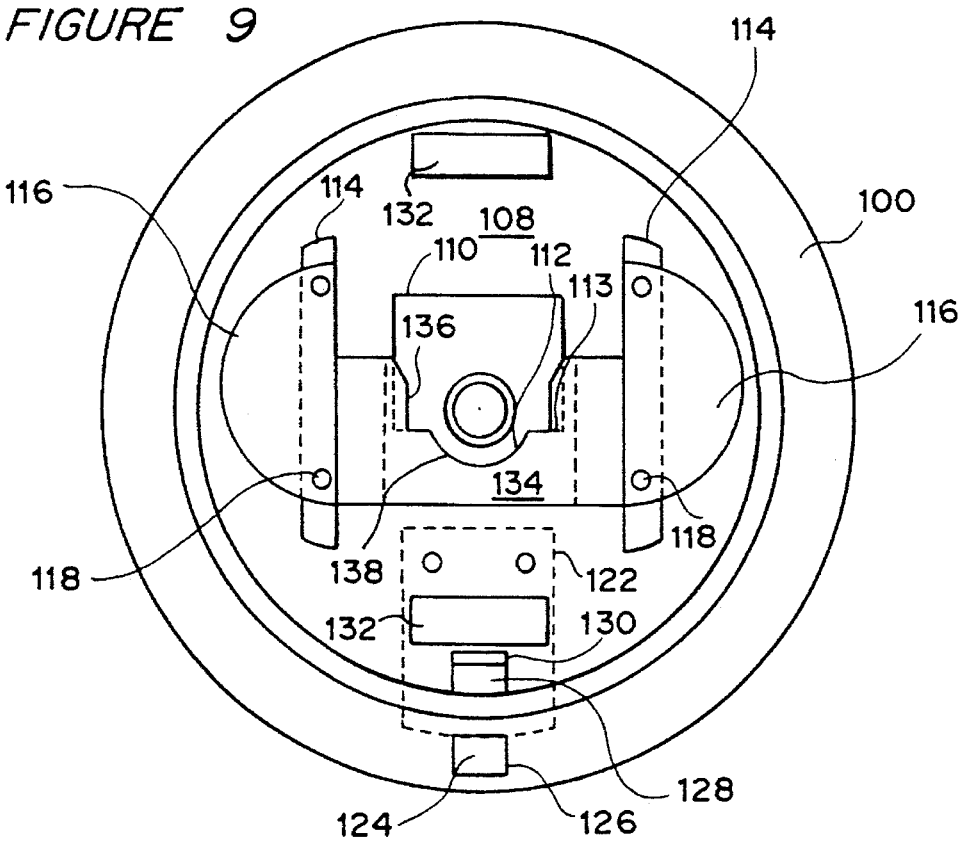
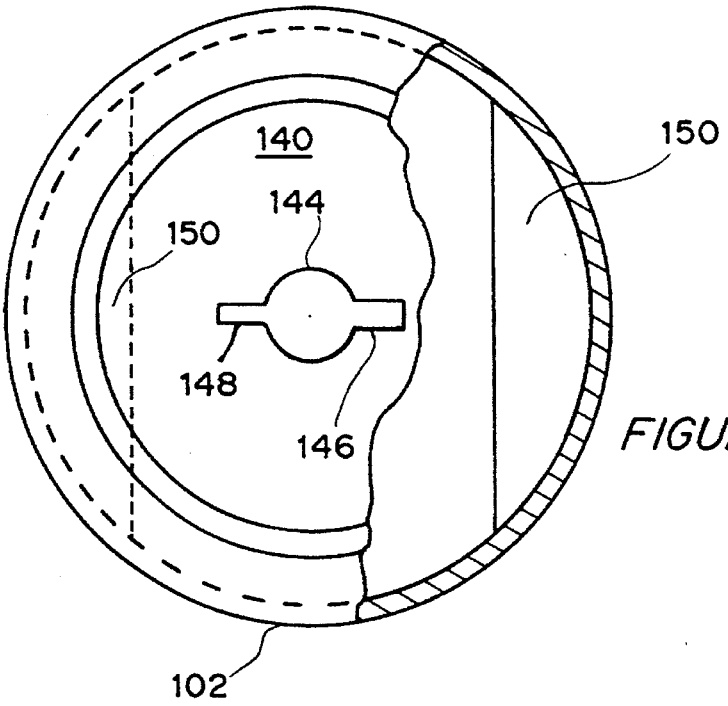
FIGURE 10

FIGURE 11
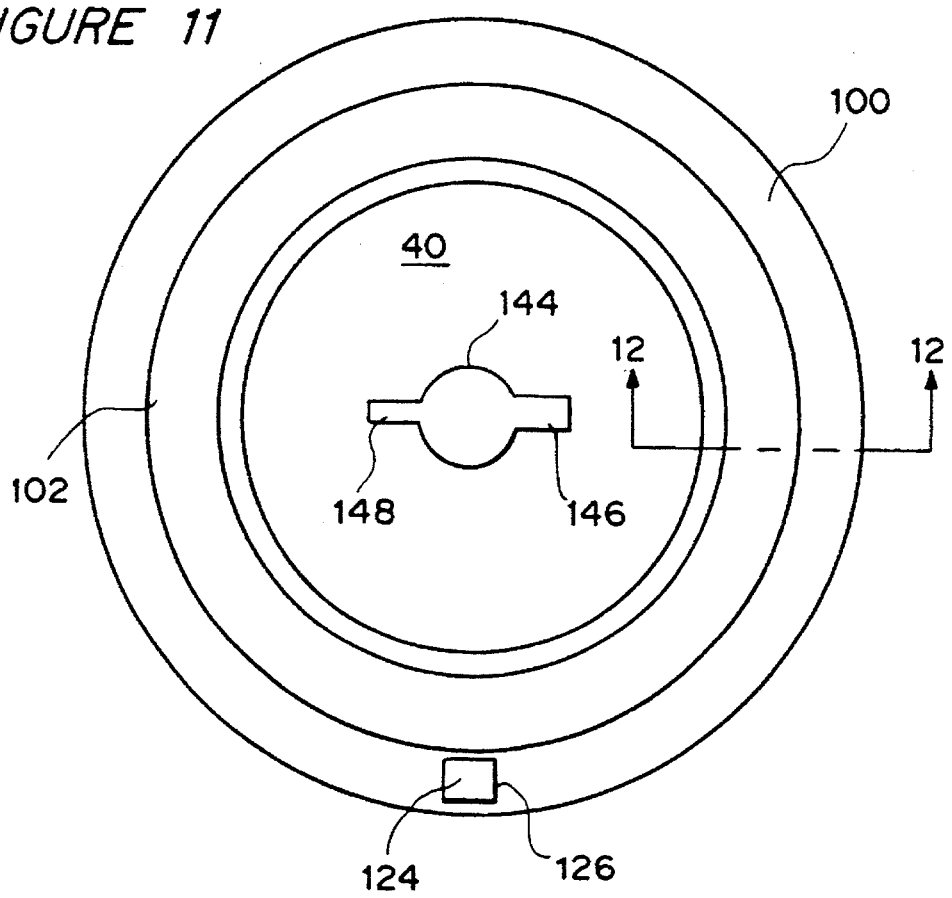
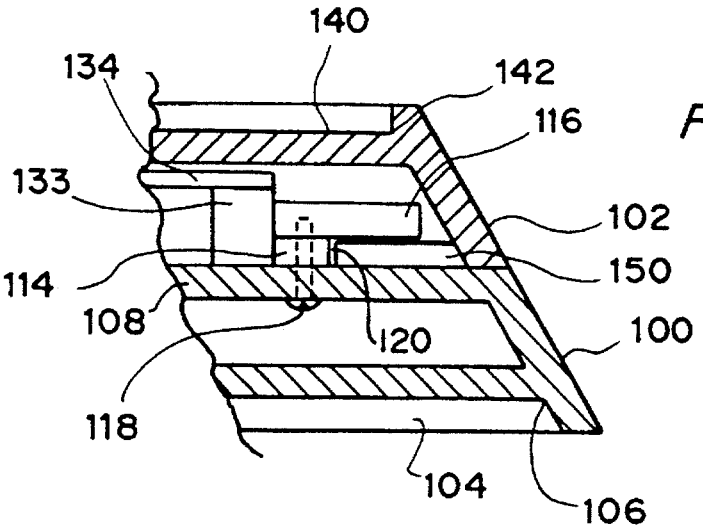
FIGURE 12

FIGURE 17
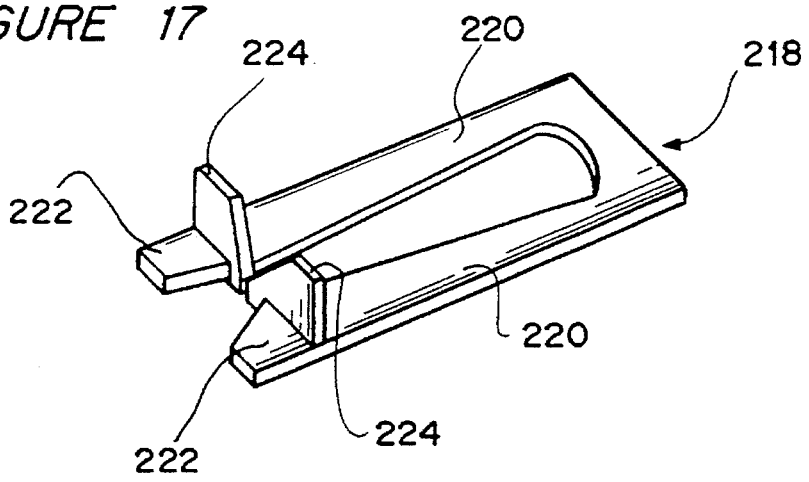
FIGURE 14
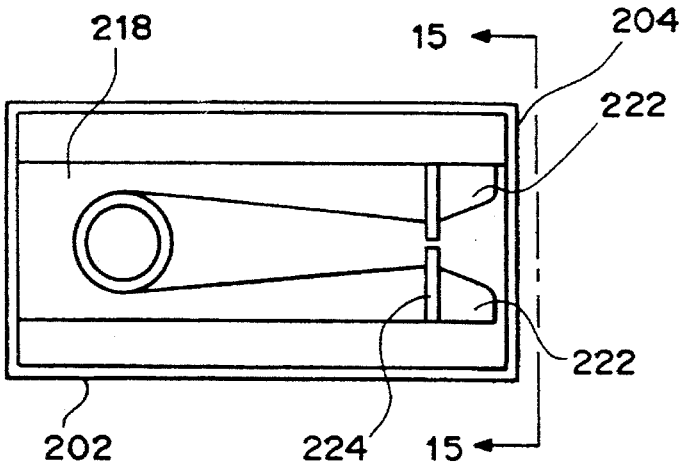
FIGURE 15
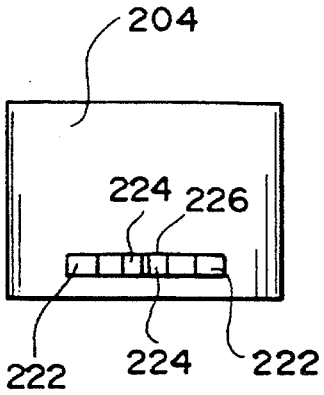
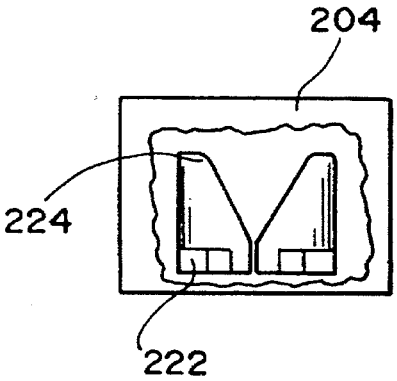
FIGURE 16

SECURED DISPOSABLE LIQUID SOAP DISPENSER

This application is a division of application Ser. No. 08/031,116 filed Mar. 12, 1993, now U.S. Pat. No. 5,350, 087, which is a division of application Ser. No. 07/661,273 filed Feb. 26, 1991, now U.S. Pat. No. 5,240,147.

BACKGROUND OF THE INVENTION

1. Field of the Invention

This invention relates generally to fluid dispensing apparatus and more particularly, to countertop mounted liquid soap dispensers.

2. Brief Description of the Prior Art

A number of countertop mounted fluid dispensers are known in the prior art. These dispensers have typically included refillable soap reservoirs into which dip tubes are inserted. Dip tubes have typically included one or two check valves with a piston-type pump. These pump and valve arrangements for countertop mounted soap dispensers have always been intended as permanent installations and over a period of time the valves and/or pumps often fail or become clogged such that no soap can be dispensed.

One such dispenser is depicted in U.S. Pat. No. 1,229,556 to Watrous. Watrous teaches a dip tube extending downward into a reservoir wherein the dip tube has a ball check valve at the base thereof. In order to refill the reservoir, it is necessary to disengage the reservoir from the mounting bracket and pour liquid soap into the open topped receptacle.

Also known in the prior art are disposable bottles which also include a dip tube and a positive displacement pump. These disposable soap dispensers are intended to merely sit on the countertop of a wash basin. The problem with using such disposable type bottles in a public restroom is that they are subject to theft.

The present invention is directed to a disposable liquid soap dispenser which overcomes the problems encountered with the soap dispensers of the prior art. In particular, the present invention is directed to a disposable liquid soap dispenser which is not readily subject to theft from public restrooms.

SUMMARY OF THE INVENTION

It is therefore an object of the present invention to provide a disposable liquid soap dispenser which discourages theft thereof.

It is a further object of the present invention to provide a disposable liquid soap dispenser which uses a mounting base intended to be permanently affixed to a countertop upon which the disposable dispenser is mounted.

Another object of the present invention is to provide a disposable liquid soap dispenser which includes engaging means extending therefrom for releasably engaging a support bracket affixed to a countertop.

Briefly stated, these and numerous other features, objects and advantages of the present invention will become readily apparent upon reading of the specifications, claims and drawings set forth hereinafter. These features, objects and advantages are accomplished through the affixation of a stationary base to a countertop. The stationary base includes at least one lug engaging port for receiving a lug extending from the base of a disposable liquid soap dispenser. The disposable liquid soap dispenser is placed on the stationary base such that the lug extending therefrom inserts into the above stated port in the stationary base and is engaged thereby. Once engaged, the disposable liquid soap dispenser cannot be removed without disengaging the locking mechanism of the stationary base. Disengagement of the locking mechanism to allow removal of the liquid soap dispenser from the stationary base may be by key, hidden button or other suitable means which discourages theft.

BRIEF DESCRIPTION OF THE DRAWINGS

FIG. 4 is a cross-sectional view of the base unit module of the present invention taken along line 4—4 of FIG. 2.

FIG. 5 is a perspective view of the sled of the first embodiment.

FIG. 6 is a perspective view of the base wall of the base unit of the first embodiment.

FIG. 7 is a perspective view of the base unit module of the second embodiment of the present invention with the upper and lower base sections in aligned position.

FIG. 8 is a perspective view of the base unit module of the second embodiment of the present invention with the upper and lower base sections in unaligned position.

FIG. 9 is a top plan view of the lower base section of the second embodiment of the present invention.

FIG. 10 is a top plan view with partial section of the upper base section of the second embodiment.

FIG. 11 is a top plan view of the base unit module of the second embodiment.

FIG. 12 is a partial sectional view of the base unit module of the second embodiment taken along line 12—12 of FIG. 11.

FIG. 14 is a top plan view of the base unit module of the third embodiment with the top wall removed.

FIG. 15 is an end view taken along line 15—15 of FIG. 14.

FIG. 16 is the same end view depicted in FIG. 15 with the end wall partially cut away.

FIG. 17 is a perspective view of the locking member of the third embodiment.

DETAILED DESCRIPTION OF THE PREFERRED EMBODIMENTS

Figure 1:
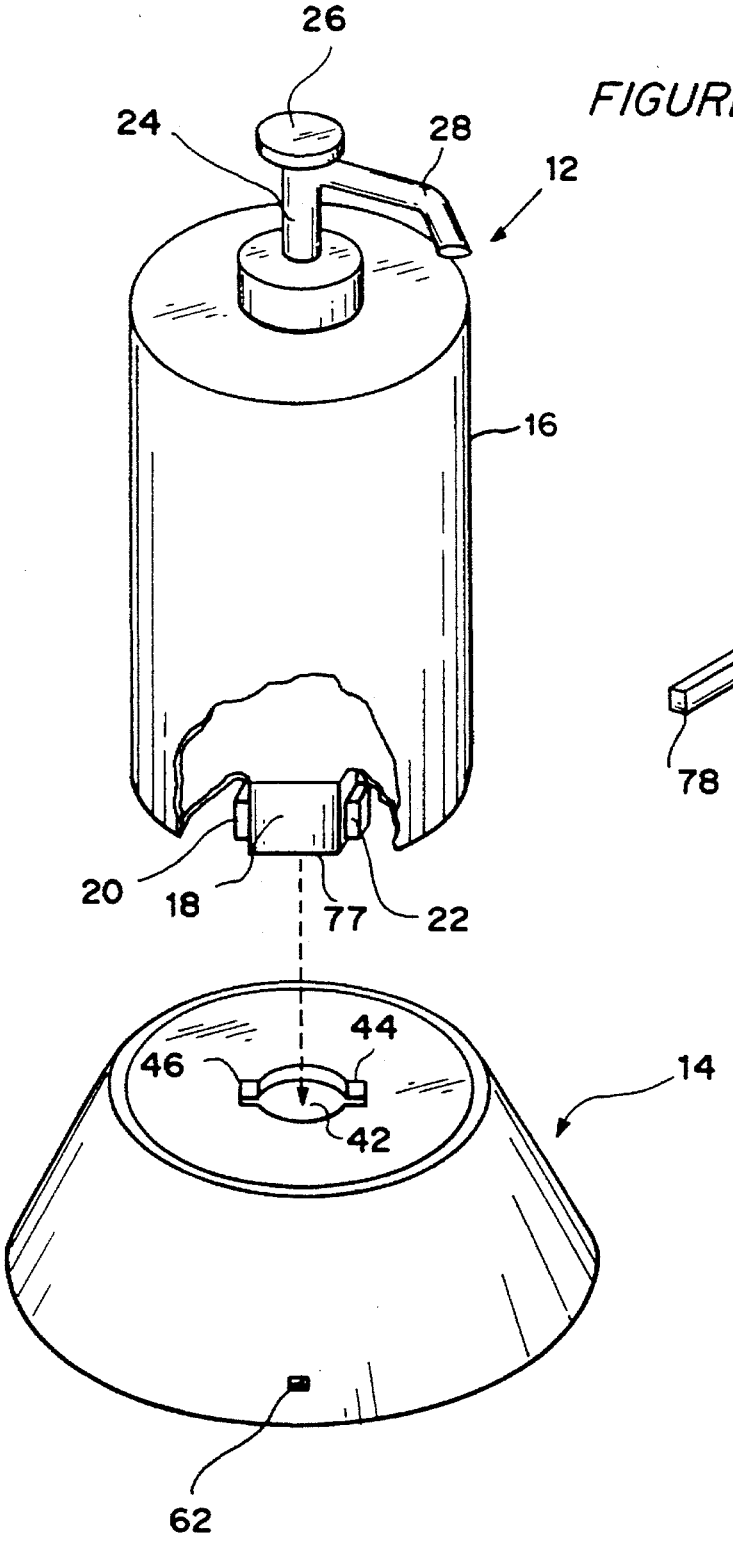
FIG. 1 is an exploded perspective view of a first embodiment of the dispensing system of the present invention with the bottle partially cut away.

Turning first to FIG. 1 there is shown an exploded isometric view of the secured liquid soap dispenser 10 of the present invention. The dispenser 10 includes a disposable dispensing module or unit 12 and a locking base module or unit 14. The disposable dispensing module 12 includes a typical blow molded bottle 16 which has a lug 18 molded as an integral part thereof extending from the bottom. Lug 18 includes a primary gib 20 and a secondary gib 22. Note that primary gib 20 is dimensionally larger than secondary gib 22. As will be discussed later, this arrangement is for fixing the orientation of disposable dispensing module 12 within locking base module 14. As is typical of disposable liquid soap dispensers, disposable dispensing module 12 includes a pump 24 which the user may actuate by depressing knob 26 to thereby deliver soap from bottle 16 through spout 28.

Figure 3:
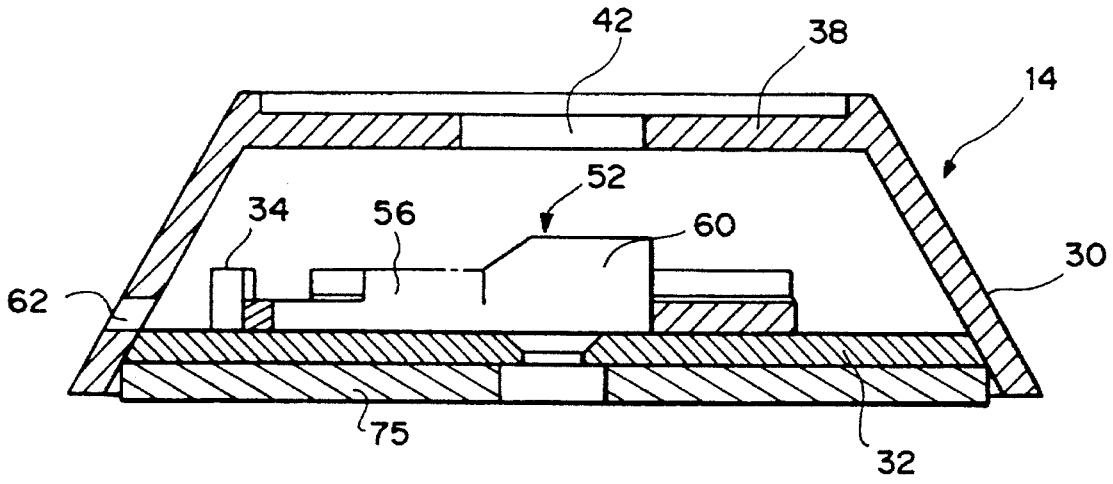
FIG. 3 is a cross-sectional view of the base unit module taken along line 3—3 of FIG. 2.

As can be seen from FIG. 1, locking base module 14 is substantially in the form of a truncated cone. From FIG. 3, which depicts a cross-sectional view of locking base module 14, it can be seen that module or unit 14 includes a truncated conical wall 30 with a base 32 affixed thereto. Extending substantially vertically upward from base 32 are partial cylindrical wall segments 34. Integrally formed with conical wall 30 is top 38. Top 38 has a lug port or orifice 42 which is substantially circular with primary and secondary slots 44, 46 extending radially therefrom 180° apart from one another.

Integrally formed with base 32 are two track members 48 as shown in FIGS. 4 and 6. Track members 48 preferably have an inverted L-shaped cross section such that there are provided opposing slots 50 in which sled 52 slidingly resides. As depicted in FIG. 5, sled 52 includes a substantially circular port 54 therethrough. Extending substantially vertically upward from sled 52 on the periphery of circular port 54 are arcuate walls 56. Extending back from circular port 54 is slot 58 through sled 52. Projecting vertically upward from sled 52 along one side of slot 58 is locking wall 60. Locking wall 60 is preferably integrally formed with the nearest of the arcuate walls 56.

Truncated conical wall 30 is provided with keyway 62 therethrough. Keyway 62 aligns with notch 64 in sled 52. Sled 52 is biased by means of spring 66 to abut cylindrical wall 34 in close proximity to keyway 62. Spring 66 is affixed at one end to post 68 projecting upward from sled 52 and integrally formed therewith. Spring 66 is affixed at the other end to post 70 projecting upward from base 32 and integrally formed therewith. Spring 66 thus retains sled 52 in a normal or first position such that slot 58 lies directly beneath lug orifice 42. Partial cylindrical wall segments 34 act as travel stops limiting the amount of lateral movement which can be imparted to sled 52.

Figure 1A:
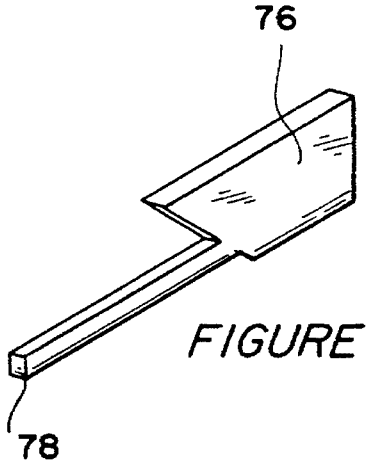
FIG. 1*a* is a perspective view of the key.

Locking base module 14 is adapted to be affixed to a countertop and convenient proximity to a wash basin. The means of affixation may be by a screw extending through recessed hole 74 in base 32 or by double faced tape 75 partially recessed in base module 14 or by other suitable fastening means. In order to install a disposable dispensing module 12 onto locking base module 14, it is necessary to employ key 76. (See FIG. 1*a*.) Key 76 includes a prong 78 which is inserted through keyway 62 such that the end of prong 78 nests within notch 64. In such manner, key 76 is used to overcome the bias of spring 66 driving sled 52 rearward to a second position thereby substantially aligning circular port 54 with lug port 42. Lug 18 is then inserted through lug port 42 such that primary gib 20 passes through primary slot 46 and secondary gib 22 extends through secondary slot 46. Once inserted, dispensing module 12 may be rotated counterclockwise. Clockwise rotation is prevented by ends 80 of arcuate walls 56 interferingly engaging gibs 20, 22. Rotation in the counterclockwise direction is limited to 90° such that the primary and secondary gibs 20, 22 strike the opposite walls of arcuate walls 56. In such manner, lug 18 is aligned with locking slot 58. Key 76 may then be removed from keyway 62 allowing sled 52 to be urged back to its original or first position by spring 66. With sled 52 in its original position, the keel 77 of lug 18 resides within locking slot 58 and lug 18 is in substantially abutting position with locking wall 60 thus preventing any further rotation of disposable dispensing module 12. Disposable dispensing module 12 is thus locked into locking base module 14.

In order to remove a spent disposable dispensing module 12, it is necessary to once again use key 76. With prong 78 urging sled 52 against the force of spring 66, sled 52 is horizontally displaced such that lug 18 becomes centered within circular port 54. Disposable dispensing module 12 can then be rotated 90° clockwise such that the primary and secondary gibs 20, 22 align with primary and secondary slots 44, 46 allowing disposable dispensing module 12 to be extracted vertically from locking base module 14.

Looking next at FIGS. 7 through 12, there is shown an alternative embodiment of the locking base module or unit 14 which may be used with the disposable dispensing module 12 depicted in FIG. 1. This alternative embodiment of locking base module or unit 14 includes a lower base section 100 and an upper base section 102 both forming truncated cones. Lower base section 100 includes a bottom wall 104 affixed thereto and residing with an annular recess 106. Lower base section 100 has a top wall 108 at the center of which is a rectangular opening 110 having an arcuate notch 112 extending from one side 113 thereof. Mounted to top plate 108 are a pair of guide members 114 which are substantially parallel to one another. Affixed to guide members 114 are retaining members 116. Guide members 114 and retaining members 116 may be affixed to top plate 108 by means of screws 118 as shown in FIGS. 9 and 12. Because retaining members 116 are wider than guide members 114, there are provided tracks or slots 120 between top wall 108 and retaining members 116.

Also affixed to top plate 108 is leaf spring 122. Leaf spring 122 has the button 124 extending through an orifice 126 in the truncated conical wall of lower base section 100. Extending up from leaf spring 122 is catch 128 such that it extends through an orifice 130 and top wall 108 in its normal, biased position. Also affixed to top wall 108 are travel stops 132.

Affixed to support blocks 133 which extend upward from top plate 108 and bridging from one support block 133 to the other support block 133 is a locking member or engaging plate 134. Locking member 134 is essentially rectangular with a rectangular cut-out 136 therein and an arcuate cut-out 138 extending back from the rectangular cut-out 136.

Figure 2:
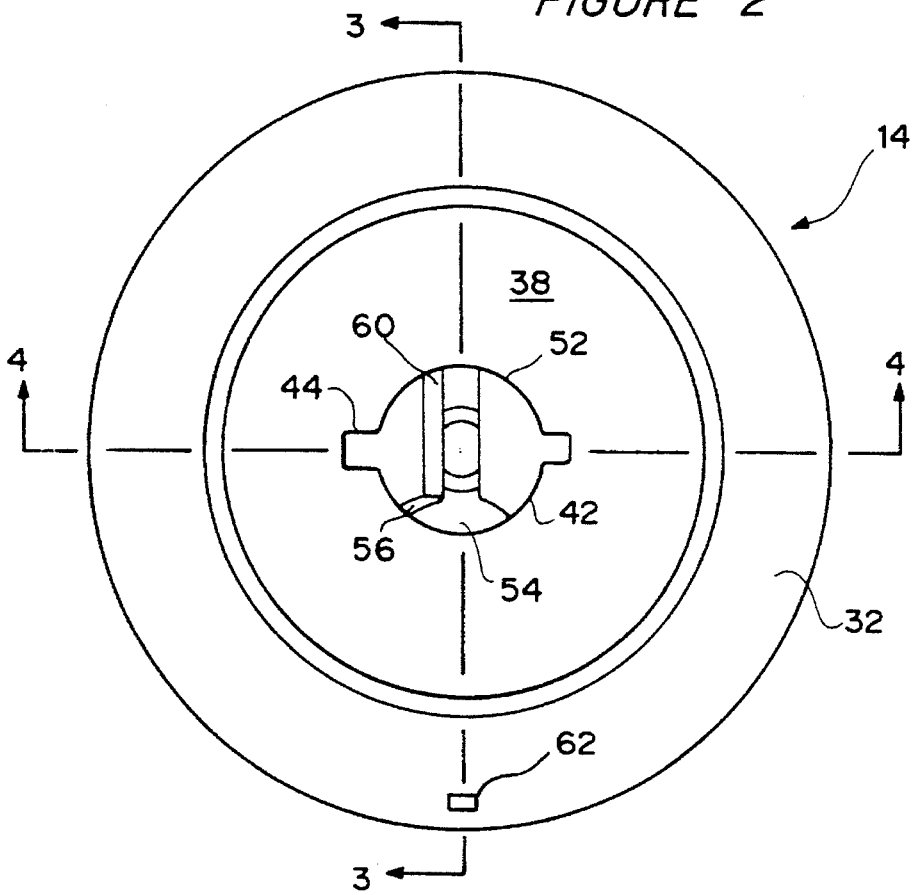
FIG. 2 is a top plan view of the base unit module of the first embodiment of the present invention.

Upper base section 102 includes a top wall 140 affixed thereto and residing within annular recess 142 of the truncated conical wall of the upper base section 102. There is a circular lug orifice or port 144 in top wall 140 (see FIG. 10) substantially identical to the lug orifice 42 shown in FIG. 2. Again there are primary and secondary slots 146, 148 extending from the circular orifice 144. Again, primary slot 146 has greater dimension than secondary slot 148 such that lug 18 can be inserted therethrough with a single correct orientation.

Affixed to the bottom of upper base member 102 are slide members 150. Slide members 150 reside within tracks or slots 120 and thus, retaining members 116 retain upper base section 102 in sliding engagement with lower base member 100.

It should be noted that this alternative embodiment does not require the use of the key to install or remove a disposable dispensing module 12 therefrom although it would be a simple matter to modify such alternative embodiment to require the use of a key. Nevertheless, the alternative embodiment as depicted still provides some security against pilferage. This type of system would require that the maintenance person perform a number of motions that would not be readily obvious to a casual user of the product. The two part locking base unit 14 would be affixed to a countertop such that button 124 is oriented approximately 180° from the user. In order to install or remove dispensing a module 12, it is necessary to depress button 124 such that catch 128 no longer engages the interior surface of the truncated conical wall of upper base section 102. When the catch 128 is disengaged, upper base section 102 may be moved laterally with slide members 150 travelling within tracks 120 until movement is stopped by the internal surface of upper base section 102 moving into abutting position with one of the travel stops 132. In such an unaligned position, lug orifice 144 no longer overlaps locking member 134 thus providing a clear path for the insertion or removal of lug 18 therethrough. To retain a dispensing module 12 to locking base module 14, once lug 18 has been inserted into lug orifice 144 such that the base of bottle 16 rests in substantially abutting position with top wall 140, upper base section 102 may be pushed laterally such that upper base section 102 moves to an aligned position with lower base section 100. This sliding movement of upper base section 102 deflects catch 128 and leaf spring 122 downward until the wall of upper base section 102 moves past catch 128. At that point, leaf spring 102 biases catch 128 upward to once again engage the internal surface of upper base section 102 such that further lateral movement is not permitted without first depressing button 124. When upper base section 102 is conically aligned with lower base section 100, primary and secondary key gibs 20, 22 reside beneath locking member 134 thus affixing dispensing module 12 to locking base module 14. Note that if the diameter of lug orifice 144 is smaller than the width of lug 18 at the base thereof where it is affixed to bottle 16, rotational movement of the dispensing module 12 is once again prevented. Rotational movement of the dispensing module 12 is also prevented by gibs 20, 22 and lug 18 moving into abutting position with side 113 of cut-out 110. It will be recognized by those skilled in the art this second embodiment may be modified to also include the requirement of rotating the dispensing module 14 clockwise or counterclockwise to install and remove module 14 as previously described with regard to the first embodiment discussed above.

A third and, perhaps, most preferred embodiment is depicted in FIGS. 13 through 17. This third embodiment also includes a stationary locking base module or unit 200 adapted to be affixed to a countertop in close proximity to a wash basin. Base 200 may be secured by means of a screw as depicted with the other embodiments discussed above or by means of a double-sided adhesive pad partially recessed in the bottom of base 200 or other suitable fastening means.

Figure 13:
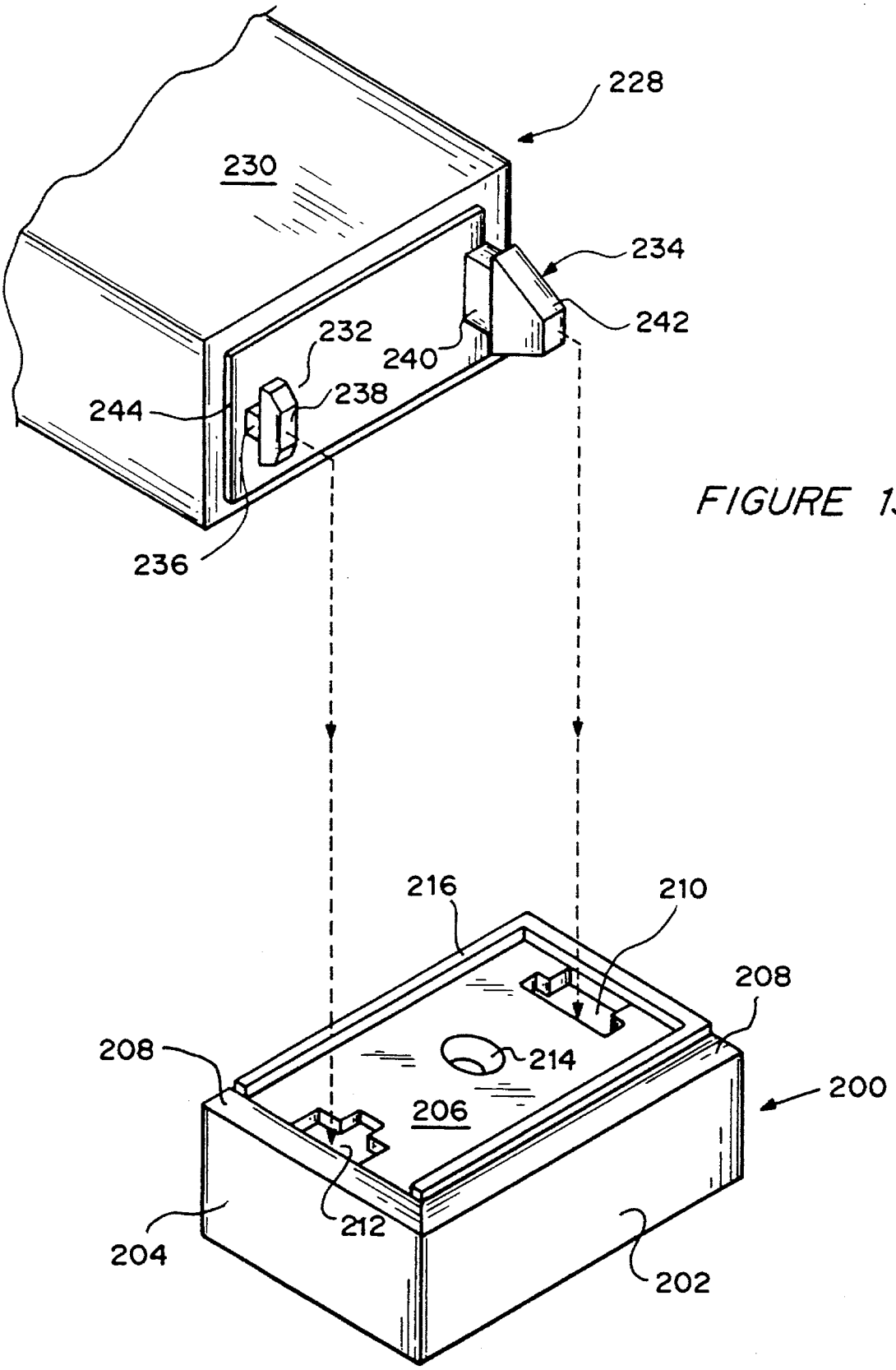
FIG. 13 is an exploded perspective view of a third embodiment of the dispensing system of the present invention.

Base unit 200 includes side walls 202, end walls 204 and top wall 206 as depicted in FIG. 13. Side walls 202 and end wall 204 may connect to top wall 206 by means of a sloping transitional wall 208. There is first T-shaped opening 210 and a second T-shaped opening 212 in top wall 206. There is also a conically shaped hole 214 through top wall 206 in which a recessed screw can be received to affix base unit 200 to a countertop. Optionally, there may be a three sided track 216 projecting upward from top wall 206.

FIG. 14 is the top plan view of base unit 200 with top wall 206 and transitional wall 208 removed. It can thus be seen that contained within base unit 200 is wishbone or sear spring member 218. Wishbone member 218 includes legs 220 having tapered ends 222. Extending up from legs 220 are gate .members 224. Gate members 224 also project inwardly from legs 220 to substantially abut one another. Gate members 224 are in substantial vertical alignment with the slot provided by first T-shape opening 210.

As shown in FIG. 15, the end wall 204 of base unit 200 nearest tapered ends 222 has a horizontal slot 226 therethrough. Horizontal slot 226 is in substantial alignment with tapered ends 222 such that tapered ends 222 can be accessed through horizontal slot 226.

The disposable dispensing module 228 employed with this embodiment includes a molded bottle 230 having a lug 232 and a key-lug protruding from the base thereof. Lug 232 and key-lug 234 may be integrally molded with the base of bottle 230 or affixed thereto. Lug 232 is substantially T-shaped having a base 236 and a cross member 238. For ease of insertion into the slot portion of T-shaped opening 212, the ends of cross member 238 may be beveled as shown in FIG. 13.

Key-lug 234 is substantially arrow shaped such that there is a shaft member 240 extending from the bottom of bottle 230 with a trapezoidal block 242 integrally formed with shaft 240. The dimensions of trapezoidal block 242 are such that it can be inserted into the slot portion of T-shaped opening 210.

Optionally, the bottom of bottle 230 could include a bottom plate 244 which would be integrally formed with lug 232, 234. Bottom plate 244 would reside within track 216 thereby providing additional stability to bottle 230.

Slot 226 is actually a keyway. In operation, a soap dispensing module 228 is placed onto a base unit 200 such that lug 232 and key-lug 234 are inserted into the respective slots of T-shaped openings 210, 212. Key-lock down member 234 engages the V created between gate members 224 and the resultant wedging action spread legs 220. (See FIG. 16 which is the same end view shown in FIG. 15 with the end wall cut away.) Once the lugs 232, 234 have been fully inserted, bottle 230 can be slid laterally to lock the disposable dispensing module 228 in place such that base 236 and shaft 240 reside within the respective bases of T-shaped openings 210, 212. The disposable dispensing module can not be vertically extracted from the base Unit 200 because top wall 206 of locking base 200 is now engaged by cross member 238 and trapezoidal block 242. Further, the lateral movement of the soap dispensing module 228 causes the trapezoidal block 242 to disengage from gate members 224 thereby allowing legs 220 to spring inwardly to their normal position. As such, gate members 224, upon assuming their original position, necessarily block any further lateral movement of the disposable dispensing module 228 because trapezoidal block 242 is now in a side-by-side relationship with closed gates 224. When a dispensing module 228 is empty and needs replacement, one need only take the new dispensing unit and insert the key-lock down member 234 into slot 226. In such manner, trapezoidal block 242 engages tapered ends 222 thereby spreading legs 220 and opening gates 224. The dispensing cartridge 228 can then be laterally removed such that lugs 232, 234 can be extracted through the slot portions of T-shaped openings 210, 212. A new dispensing module 228 can then be mounted on base module 200.

The present invention allows the placement of disposable liquid soap dispensers in public restrooms which will not readily be susceptible to theft. In addition, because all of the embodiments require lugs extending from the base of the dispensing modules, such modules would not be readily useable by one not having a base unit 200 to use in conjunction therewith. The lugs extending from the base of the bottle would prevent the bottle from standing in the desired vertical orientation without a base unit 200. Thus, not only does the present invention deter theft, theft becomes unappealing because the dispenser by itself is not readily adaptable for home use.

Preferably, with all three above-described embodiments, the base unit modules would be molded from ABS or a similar injection moldable plastic. The bottle portion of the dispensing unit would preferably be blow molded from polypropylene.

Figure 18:
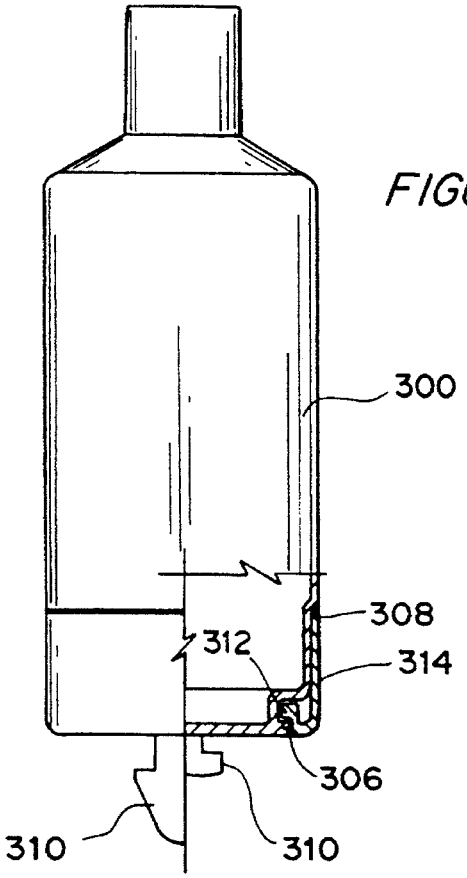
FIG. 18 is a front elevational view with partial section of an alternative bottle design.
Figure 19:
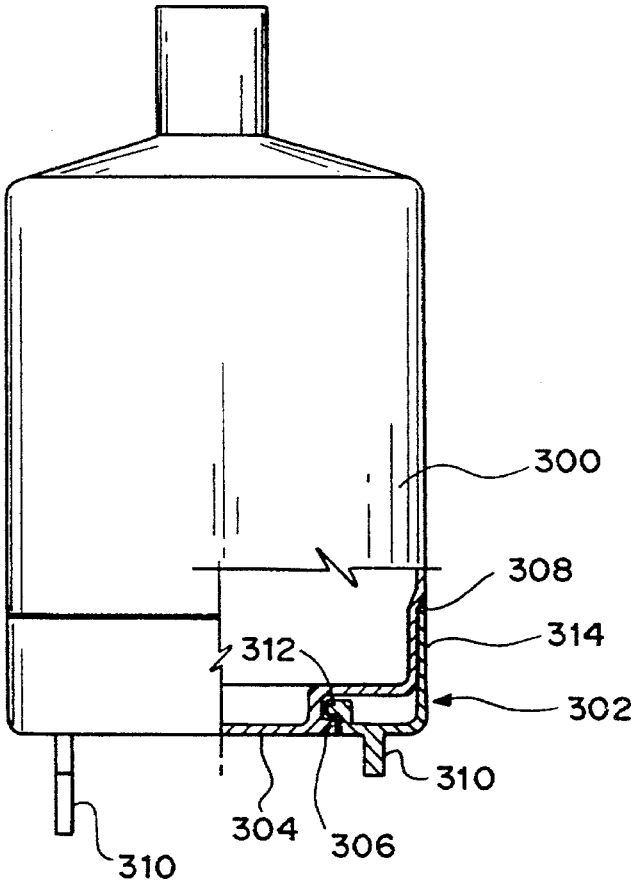
FIG. 19 is a side elevational view with partial section of the alternative bottle design depicted in FIG. 18.

An alternative bottle construction is shown in FIGS. 18 and 19. The bottle 300 is once again blow molded. Recognizing that lugs integrally formed with the blow molded bottle 300 may not be particularly rigid, the alternative bottle 300 is adapted to have connected thereto a bottom cap 302 which is also molded, but of more rigid construction. As depicted, bottle 300 includes a bottom well 304 which is preferably circular. Extending from bottom well 304 is annular lip 306. Bottle 300 also includes a circumferential recess 308.

Integrally formed with bottom cap 302 are lugs 310. Also integrally formed with bottom cap 302 is annular ridge 312. Bottom cap 302 is press fit onto bottle 300 such that the circumferential wall 314 of bottom cap 302 resides substantially within circumferential recess 308. As annular lip 306 moves past annular ridge or shelf 312, an aggressive bead lock is formed there between locking bottom cap 302 to bottle 300. It is preferred that bottom cap 302 be molded from ABS or a similar injection moldable plastic and, as such, would be much more rigid than polypropylene bottle 300.

Although the dispensing modules of the present invention are preferably disposable, it should be recognized that such modules could be refillable. In such case, the dispensing module would likely require a more durable construction.

From the foregoing, it would be seen that this invention is one well adapted to attain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A countertop mounted fluid dispensing system comprising:

a base unit adapted to be affixed to a countertop, said base unit including a locking means and at least one lug orifice;

said base unit further comprising an upper base section having a top wall with said lug orifice therethorough;

slide members affixed within said upper base section;

a lower base section including a top plate;

and track means mounted to said top plate of said lower base section for slidably engaging slide members so that said upper base section is moveable from an aligned position with said lower base section to an unaligned position with said lower base section; and a fluid dispenser including a bottle and a lug extending from said bottle, said lug adapted to be received in said lug orifice and engaged by said locking means.

2. A countertop mounted fluid dispensing system as recited in claim 1, said further comprising:

a primary gib and a secondary gib, each extending from said lug.

3. A countertop mounted fluid dispensing system as recited in claim 2 wherein:

said primary gib is larger than said secondary gib so that said lug can be inserted into said lug orifice with a single orientation.

4. A countertop mounted fluid dispensing system as recited in claim 1, said locking means comprising:

a gib engaging plate supported from said top plate of said lower base section to reside in a fixed position in close proximity to said top wall of said upper base section such that said lug can be inserted through and extracted from said lug orifice only when said upper base section is in said unaligned position.

5. A countertop mounted fluid dispensing system as recited in claim 4 wherein:

said gib engaging plate resides between at least one of said gibs and at least one of said gib slots when said upper base section is in said aligned position.

6. A countertop mounted fluid dispensing system as recited in claim 1 further comprising:

a travel stop means affixed to said lower base section for limiting the amount of lateral travel which can be imparted to said upper base section as a result of said slide members moving in said track means.

7. A countertop mounted fluid dispensing system as recited in claim 1 further comprising:

releasable catch means for fixing said upper base section in said aligned position.

* * * * *